US008830128B2

(12) United States Patent
Fuchs et al.

(10) Patent No.: US 8,830,128 B2
(45) Date of Patent: Sep. 9, 2014

(54) SINGLE FEED MULTI-FREQUENCY MULTI-POLARIZATION ANTENNA

(75) Inventors: Andreas D. Fuchs, Lake Orion, MI (US); Elias H. Ghafari, Rochester Hills, MI (US); Nikola Dobric, Munich (DE)

(73) Assignee: Kathrein Automotive North America, Inc., Rochester Hills, MI (US)

( * ) Notice: Subject to any disclaimer, the term of this patent is extended or adjusted under 35 U.S.C. 154(b) by 463 days.

(21) Appl. No.: 13/288,467

(22) Filed: Nov. 3, 2011

(65) Prior Publication Data

US 2012/0319922 A1 Dec. 20, 2012

Related U.S. Application Data

(63) Continuation-in-part of application No. 13/159,775, filed on Jun. 14, 2011, now Pat. No. 8,760,362.

(51) Int. Cl.

| | |
|---|---|
| ***H01Q 1/38*** | (2006.01) |
| ***H01Q 5/00*** | (2006.01) |
| ***H01Q 1/24*** | (2006.01) |
| ***H01Q 1/32*** | (2006.01) |
| ***H01Q 9/04*** | (2006.01) |

(52) U.S. Cl.

CPC ..... *H01Q 1/38* (2013.01); *H01Q 5/0044* (2013.01); *H01Q 1/243* (2013.01); *H01Q 1/3275* (2013.01); *H01Q 9/0428* (2013.01)

USPC ..... 343/700 MS

(58) Field of Classification Search

USPC ..... 343/700 MS, 866, 872

See application file for complete search history.

(56) References Cited

U.S. PATENT DOCUMENTS

| | | | | |
|---|---|---|---|---|
| 6,876,328 | B2 * | 4/2005 | Adachi et al. | 343/700 MS |
| 7,075,490 | B2 * | 7/2006 | Noro | 343/713 |
| 7,164,385 | B2 | 1/2007 | Duzdar et al. | |
| 7,227,500 | B2 | 6/2007 | Oshima et al. | |
| 7,253,770 | B2 | 8/2007 | Yegin et al. | |
| 7,405,700 | B2 | 7/2008 | Duzdar et al. | |
| 7,548,207 | B1 * | 6/2009 | Chu et al. | 343/700 MS |
| 7,994,999 | B2 * | 8/2011 | Maeda et al. | 343/853 |
| 8,174,455 | B2 * | 5/2012 | Miyoshi et al. | 343/728 |
| 2009/0002229 | A1 | 1/2009 | Noro et al. | |

* cited by examiner

*Primary Examiner* — Tan Ho

(74) *Attorney, Agent, or Firm* — Warner Norcross & Judd LLP

(57) ABSTRACT

An antenna capable of receiving both left-hand circularly polarized (LHCP) signals and right-hand circularly polarized (RHCP) signals, and outputting both signals on a single feed. The antenna includes two coplanar concentric patches. The inner patch is substantially square. The outer patch surrounds the inner patch to define a gap therebetween. A resonant parallel inductive/LC circuit interconnects the two patches. The circuit includes a plurality of printed traces within the gap and interconnecting the concentric patches. The gap and each trace function as an LC circuit.

12 Claims, 12 Drawing Sheets

The SDARS LHCP zenith gain is 5dB and its cross-polarized (RHCP) gain is -8dB.

The GPS RHCP zenith gain is 4dB and its cross-polarized (LHCP) gain is -7dB.

The antenna input match is 2:1 for both SDARS and GPS

SINGLE FEED MULTI-FREQUENCY MULTI-POLARIZATION ANTENNA

BACKGROUND OF THE INVENTION

The present invention relates to antennas and more particularly to single-feed multi-frequency multi-polarization antennas.

Antennas are in widespread use in automobiles, which typically include antennas for one or more of AM radio, FM radio, satellite radio, cellular phones, and GPS. These signals are of different frequencies and polarizations. For example, the signals associated with satellite radio (e.g. brand names XM® and Sirius®) are in the range of 2.320 to 2.345 GHz and are left-hand circularly polarized (LHCP); and the signals associated with global positioning systems (GPS) are in the range of 1.574 to 1.576 GHz and are right-hand circularly polarized (RHCP).

Antenna packages have been developed to receive and output multiple signals. At least one such package outputs the multiple signals on a single feed as disclosed in U.S. Pat. No. 7,164,385 issued Jan. 16, 2007 and U.S. Pat. No. 7,405,700 issued Jul. 29, 2008 both to Duzdar et al. As described in the patents, the disclosed antenna includes coplanar inner and outer patches. The outer patch surrounds the inner patch. The two patches are physically spaced from one another. A single feed is connected to the inner patch. The inner patch resonates at a first frequency with a first antenna polarization sense. The inner and outer patches together resonate at a second frequency with a second polarization sense. Both signals are outputted on the single feed.

Unfortunately, the prior art antenna has two shortcomings. First, the antenna is difficult to manufacture and to tune. While a consistent accurate gap between the antenna elements is important for the proper function of the antenna, current screening and printing processes do not provide the desired accuracy to produce antennas having a consistent accurate gap between the elements. Second, the two frequency bands cannot be tuned independently.

SUMMARY OF THE INVENTION

The aforementioned shortcomings are addressed by the antenna of the present invention, which is a single-feed multi-frequency multi-polarization antenna having inductive coupling between the inner and outer patches.

In the current embodiment, the antenna includes coplanar inner and outer patches. The outer patch surrounds the inner patch. The two patches are physically spaced from one another. A single feed is connected to the inner patch. The inner patch resonates at a first frequency with a first polarization sense. The inner and outer patches together resonate at a second frequency with a second polarization sense. The inner and outer patches are connected to each other by a plurality of relatively long, relatively thin traces. Each trace functions as an inductor. The individual traces or inductors are resonant and in parallel.

The inductors couple the outer patch signals to the outer patch and prevent the inner patch signals from coupling to the outer patch. The antenna of the present invention is relatively simple and inexpensive, and provides significantly enhanced manufacturability and performance over known antennas.

These and other advantages and features of the antenna will be more fully understood and appreciated by reference to the description of the current embodiment and the drawings.

DESCRIPTION OF THE CURRENT EMBODIMENTS

I. First Embodiment

Figure 1:
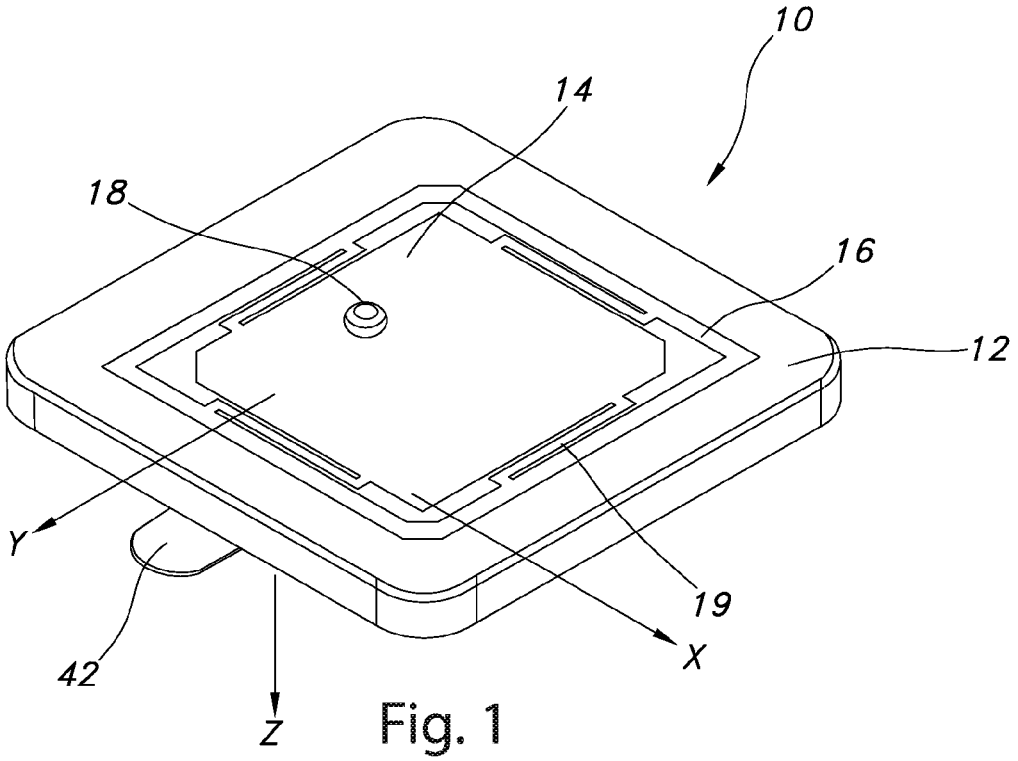
FIG. 1 is a perspective view of an antenna in accordance with a first embodiment of the invention.
Figure 3:
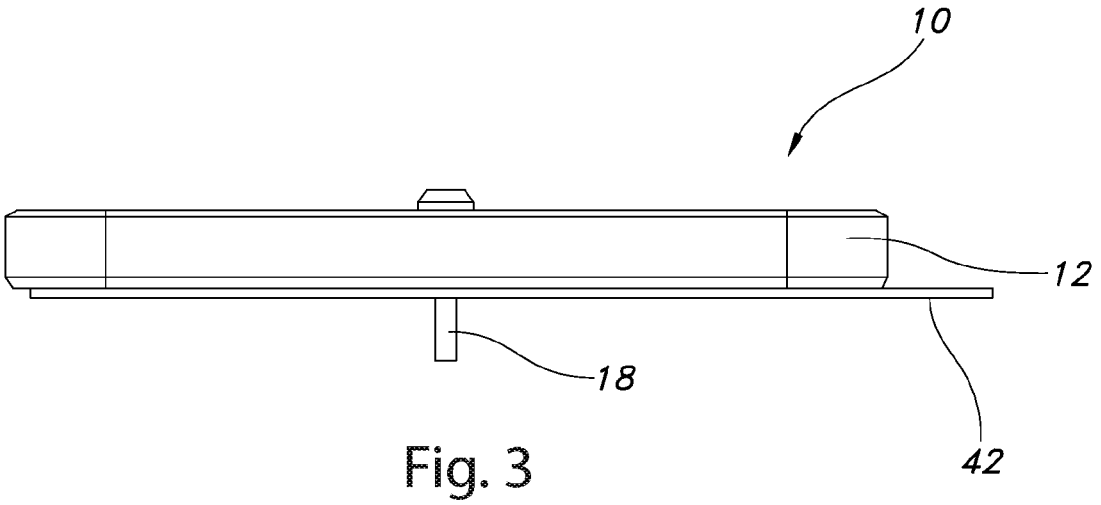
FIG. 3 is a side elevation view of the antenna of FIG. 1.
Figure 2:
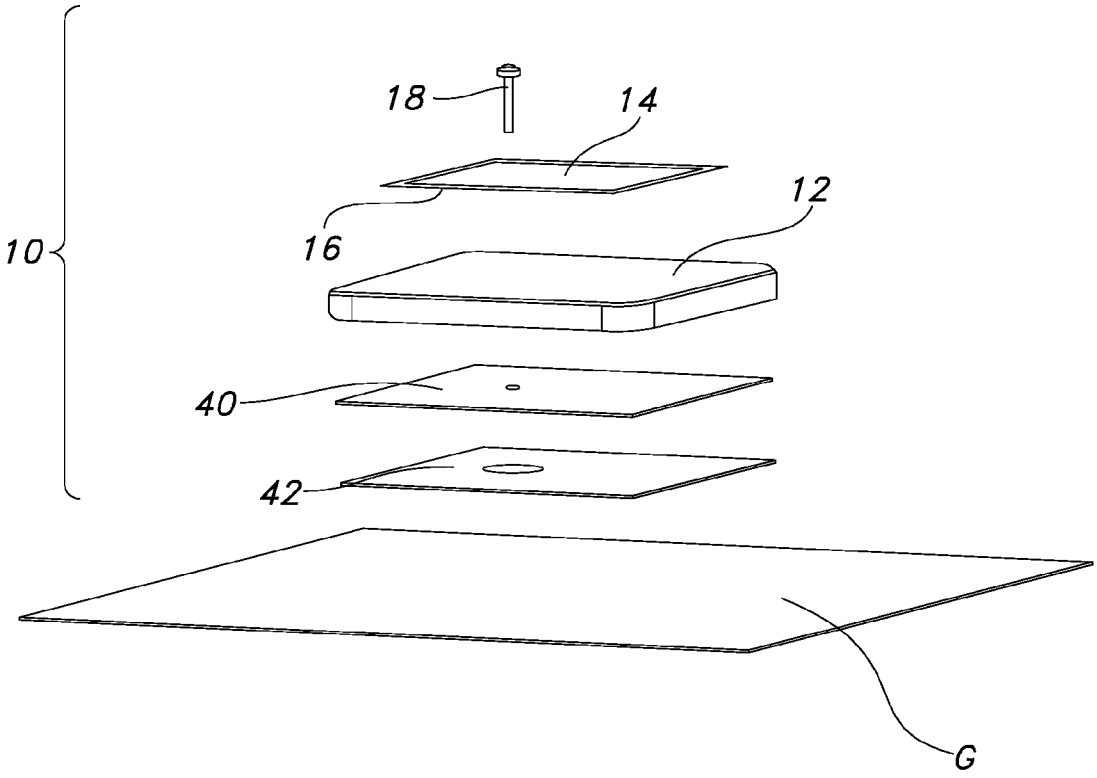
FIG. 2 is an exploded perspective view of the antenna of FIG. 1 but not including the adhesive release liner.

An antenna constructed in accordance with a first embodiment of the invention is illustrated in FIGS. 1-4 and generally designated 10. The antenna includes a substrate 12, an inner patch 14, an outer patch 16, a single feed or lead 18, and a plurality of traces 19 interconnecting the inner patch and the outer patch. The inner and outer patches 14 and 16 and the traces 19 are screened or printed on the substrate 12. The single feed 18 extends through the substrate 12 and is connected to the inner patch 14. The inner patch 14 receives a signal having a first frequency and a first polarization, and the inner and outer patches 14 and 16 together receive signals having a second frequency and a second polarization. The frequencies and polarizations are different. Both signals are outputted on the single feed 18.

The substrate 12 is well known to those skilled in the antenna art. The substrate can be fabricated of any suitable electrically nonconductive (i.e. dielectric) material such as plastic or ceramic. In the current embodiment, the material is a ceramic having a DK value in the range of 8 to 25. Alternatively, the material could be a PCB material having a DK value in the range of 1 to 15. Further alternatively, the material could be any suitable material. The substrate 12 supports the remaining elements of the antenna 10.

Figure 4:
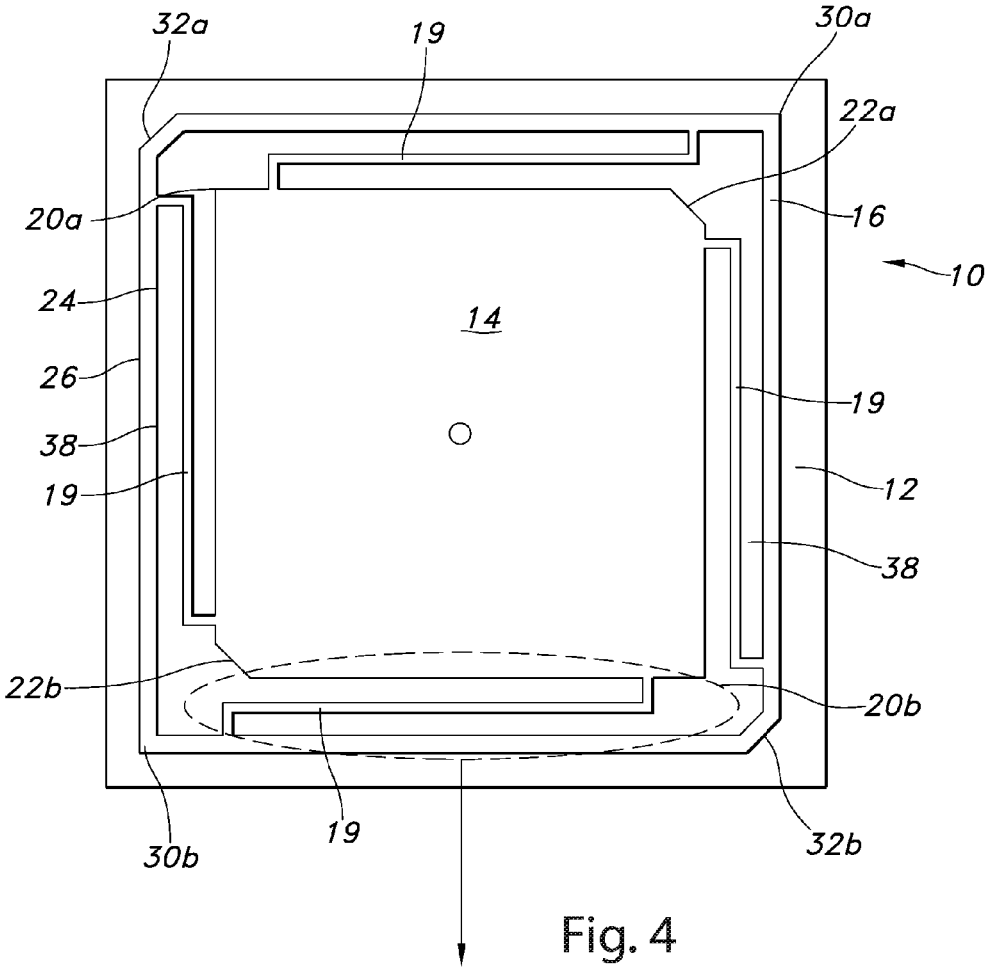
FIG. 4 is a top plan view of the antenna of FIG. 1.

The inner patch 14 is substantially or generally square when viewed in plan view (see particularly FIG. 4). As a square, it has four corners 20*a*, 20*b*, 22*a*, and 22*b*. Two diagonally opposite corners 20*a* and 20*b* are substantially square, and the other two diagonally opposite corners 22*a* and 22*b* are substantially non-square as is conventional for antennas for circularly polarized signals. In the current embodiment, the corners 22*a* and 22*b* are cut at a 45° angle to the sides of the inner patch 14. Other appropriate techniques for non-squaring the corners 22*a* and 22*b* are and will be known to those skilled in the art.

The outer patch 16 surrounds the inner patch 14. The outer patch 16 has a substantially square inner edge 24 and a substantially square outer edge 26. The two edges 24 and 26 are substantially concentric. The inner edge 24 of the outer patch 16 is substantially square and includes four corners 30*a*, 30*b*, 32*a*, and 32*b*. In the current embodiment, the width of the patch 16 is general uniform throughout its circumference. Two diagonally opposite corners 30*a* and 30*b* are substantially square, and the other two diagonally opposite corners 32*a* and 32*b* are substantially not square. The square corners

30*a* and 30*b* are proximate or adjacent to the non-square corners 20*a* and 20*b* on the inner patch 14. And the non-square corners 32*a* and 32*b* are proximate or adjacent to the non-square corners 22*a* and 22*b* on the inner patch 14.

The inner edge 24 of the outer patch 16 is spaced from the inner patch. Therefore, the patches 14 and 16 define a gap 38 therebetween so that the patches 14 and 16 are physically separate from one another. The width of the gap is generally uniform about the perimeter of the inner patch 14. The gap widens in the areas of the corners 22*a*, 22*b*, 30*a*, and 30*b*.

Traces 19 extend between and interconnect the inner patch 14 and the outer patch 16. In the current embodiment, one trace is provided on each of the four sides of the inner patch 14. A larger or smaller number of traces can be provided. Each trace is relatively long and relatively thin. In the current embodiment, each trace is longer than one-half the length of the associated side of the inner patch 14, and is almost as long as the length of the side. The opposite ends of each trace 19 connect to the inner and outer patches 14 and 16. The remainder of each trace 19 is spaced from the inner and outer patches 14 and 16, and the width of each trace 19 is generally uniform throughout its length.

Figure 5:
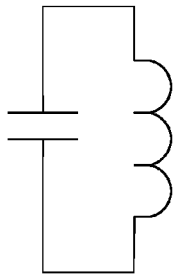
FIG. 5 is a schematic drawings illustrating the function of the gap and the traces.

The traces 19 function as inductors to inductively couple the outer patch 16 to the inner patch 14. Gap 40 functions as a capacitor, at least at some small level. Consequently, it is believed that the gap 40 and each trace 19 together function as a capacitor/inductor (LC) circuit as schematically illustrated in FIG. 5. And it is further believed that the gap 40 and the traces collectively function as a parallel resonant LC circuit coupling the outer patch signal (e.g. GPS) to the outer patch and to prevent the inner patch signal (e.g. SDARS) from coupling to the outer patch. Measurement of the capacitive function of the gap 40 and the inductive function of the traces 19 has proven difficult because any attempted measurement distorts the actual values.

The antenna 10 further includes a bottom metalized layer 40 on the lower surface of the substrate 12. A double-sided adhesive material 42 is applied to the bottom metallization 40. The adhesive material 42 may or may not be electrically conductive. A release liner 44 covers the underside of the adhesive material 42, and is removed when the antenna is to be attached to a supporting structure such as the illustrated ground plane G.

In the current embodiment, the patches 14 and 16, the traces 19, and the bottom layer 40 are silver or other suitable metal screened, printed, or otherwise formed directly on the substrate 12. The patches 14 and 16, the traces 19, and the bottom layer 40 are substantially planar. The patches 14 and 16 and the traces 19 are substantially coplanar. Currently, all of the elements are printed of the same material and thickness. Alternatively, the elements could be printed of different materials and/or thicknesses.

The relative sizes, shapes, and orientations of the patches 14 and 16 and the traces 19 can be tuned or otherwise modified to achieve desired performance. The patches 14 and 16 and the traces 19 shown in the drawings illustrate the current embodiment, which has been tuned to provide a balance among the performance factors. Those skilled in the art will recognize that the patches can be tuned differently to achieve different balances among the performance factors.

It is presently believed that the L and C values to be provided by the gap 40 and the traces 19 cannot be mathematically determined. The current embodiment was developed through trial and error, and simulations of the various designs.

The LC circuit provides a band stop filter (high impedance) for the inner patch (e.g. SDARS) frequencies and tends to make the outer patch (e.g. GPS) invisible to the inner patch. If the outer patch and the traces are removed, the inner patch functions almost unaffected. For the outer patch frequencies (e.g. GPS), the LC circuit presents a low impedance enabling the inner patch to connect to the outer patch—together creating a larger effective patch for the outer patch frequency range.

The formula used to determine the resonant frequency is:

$$f = \frac{\omega}{2\pi} = \frac{1}{2\pi\sqrt{LC}}.$$

Consequently, an infinite number of combinations of L and C will result in the same resonant frequency. The current embodiment is a tuned antenna for a dielectric constant (DK) of 9.5. If the DK is changed, the relative dimensions of the components also must change. The lower the DK of the substrate, the larger the patch and the traces must be. It is possible to replace the traces 19 with discrete L and C components soldered or otherwise connected between the inner and outer patches.

The single feed 18 is connected only to the inner patch 14. The feed 18 extends through the substrate 12. The feed 18 is connected off center of the inner patch 14 as is conventional for antennas for circularly polarized signals.

Operation

The antenna 10 outputs two different signals having different frequencies and different polarizations on the single feed 18. The inner patch 14 receives left-hand circularly polarized (LHCP) signals—for example those associated with satellite radio (SDARS). The patches 14 and 16 together receive right-hand circularly polarized (RHCP) signals—for example those associated with GPS signals.

In operation, the antenna 10 would be connected to an amplifier and a dual passband filter (not shown) both of any suitable design known to those skilled in the art. When the antenna 10 is for satellite radio signals and GPS signals, the two passbands are in the range of 2.320 to 2.345 GHz for the satellite radio signal, and in the range of 1.574 to 1.576 GHz for the GPS signal. The output of the amplifier and filter may be fed to a satellite radio receiver and/or a GPS unit.

Figure 6:
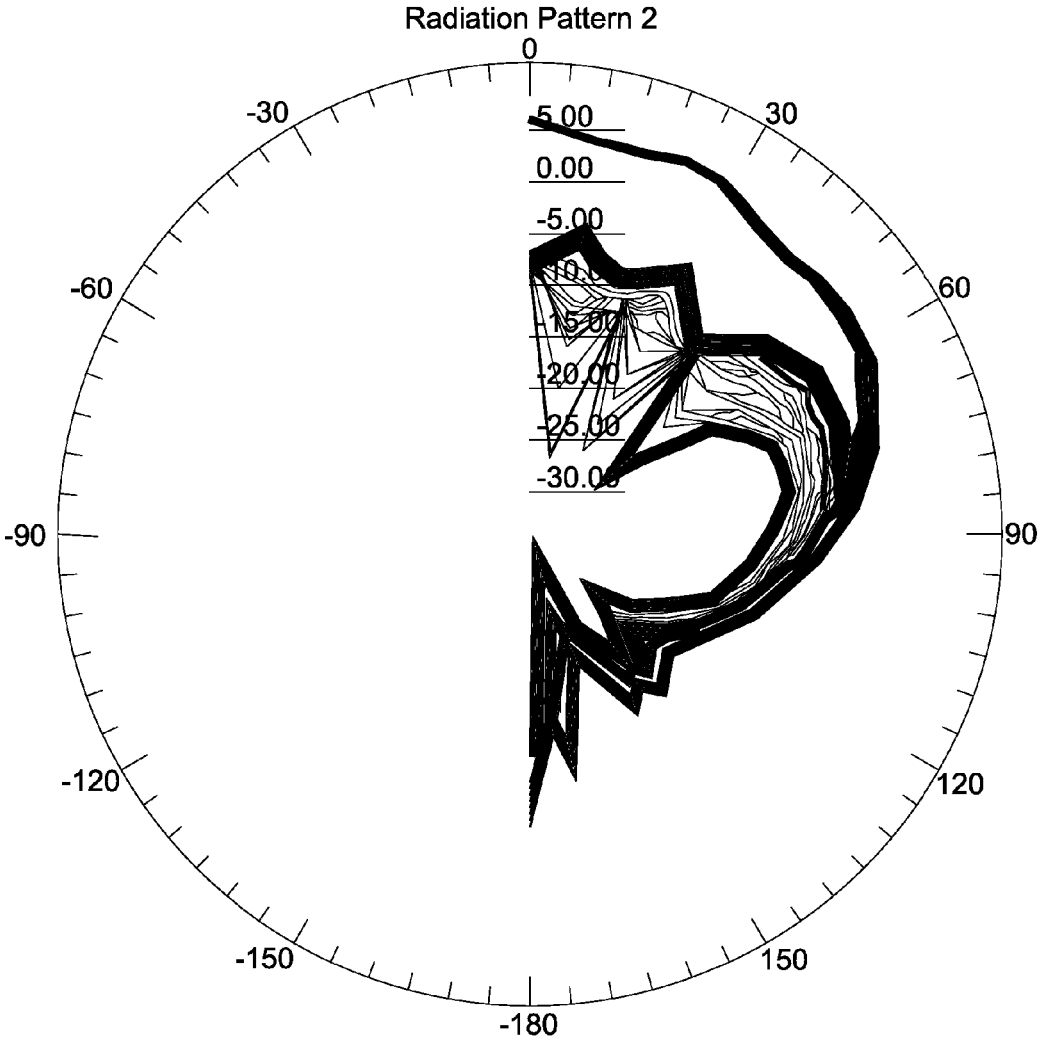
FIGS. 6-8 are plots illustrating the performance of the antenna of FIG. 1.
Figure 7:
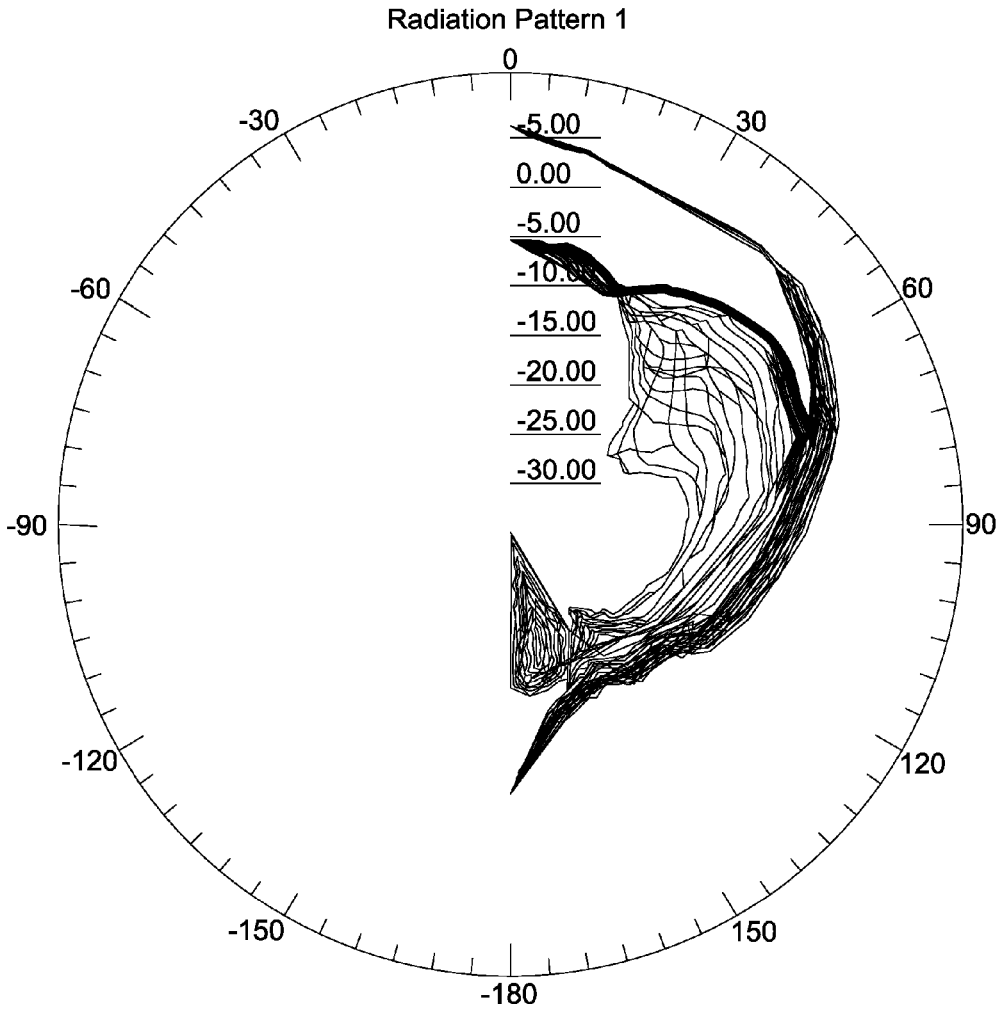
Figure 8:
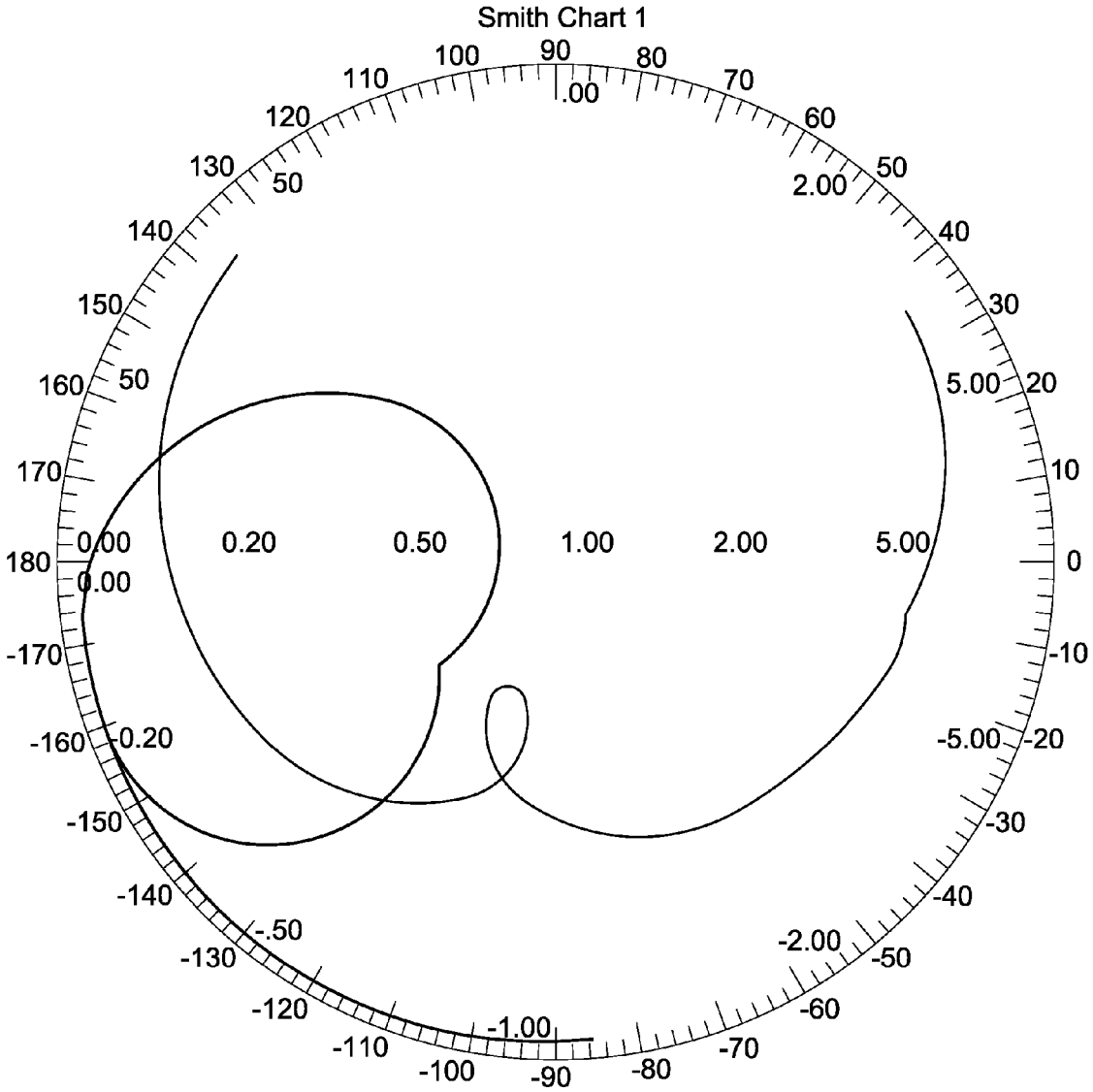

FIGS. 6-8 are plots illustrating the performance of the current antenna.

FIG. 6 is a radiation pattern for the current antenna showing that the SDARS LHCP zenith gain is 5 dB and that its cross-polarized (RHCP) gain is −8 dB.

FIG. 7 is a radiation pattern for the current antenna showing that the GPS RHCP zenith gain is 4 dB and that its cross-polarized (LHCP) gain is −7 dB.

FIG. 8 is a Smith chart showing the impedance of the coplanar patches.

II. Second Embodiment

Figure 9:
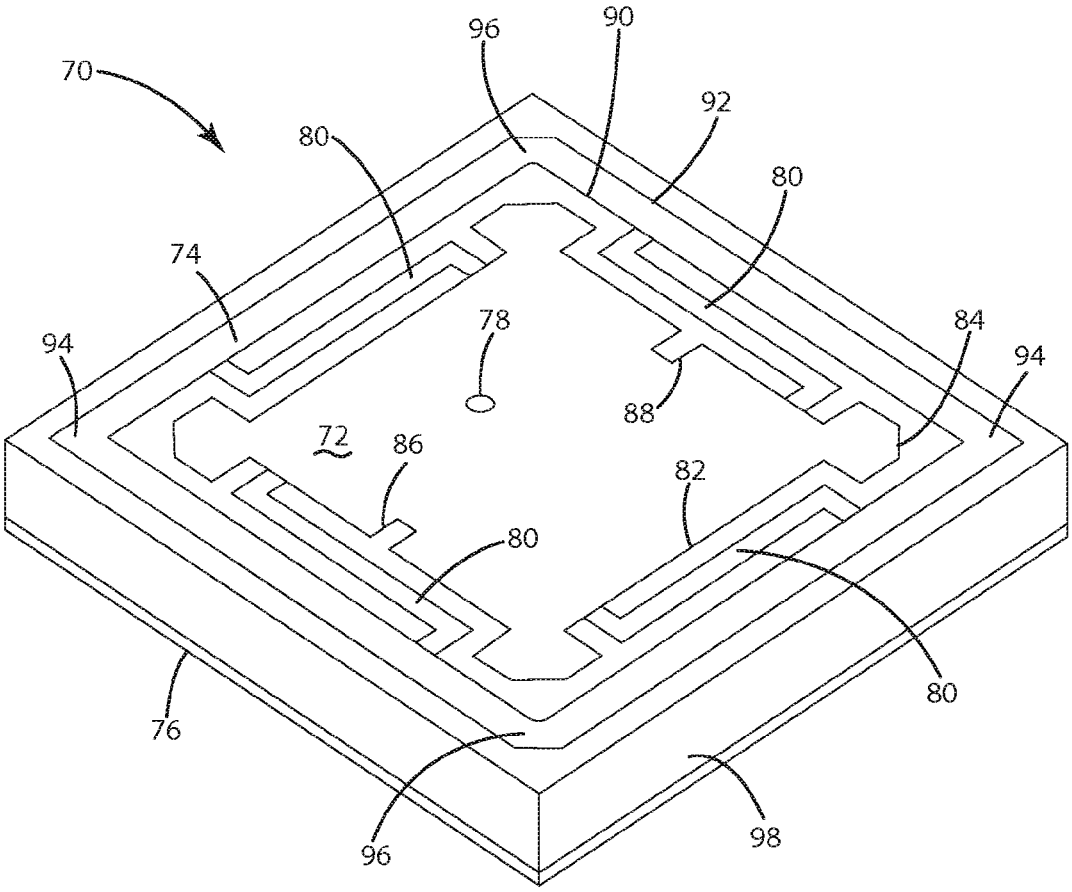
FIG. 9 is a perspective view of an antenna in accordance with a second embodiment of the invention.
Figure 10:
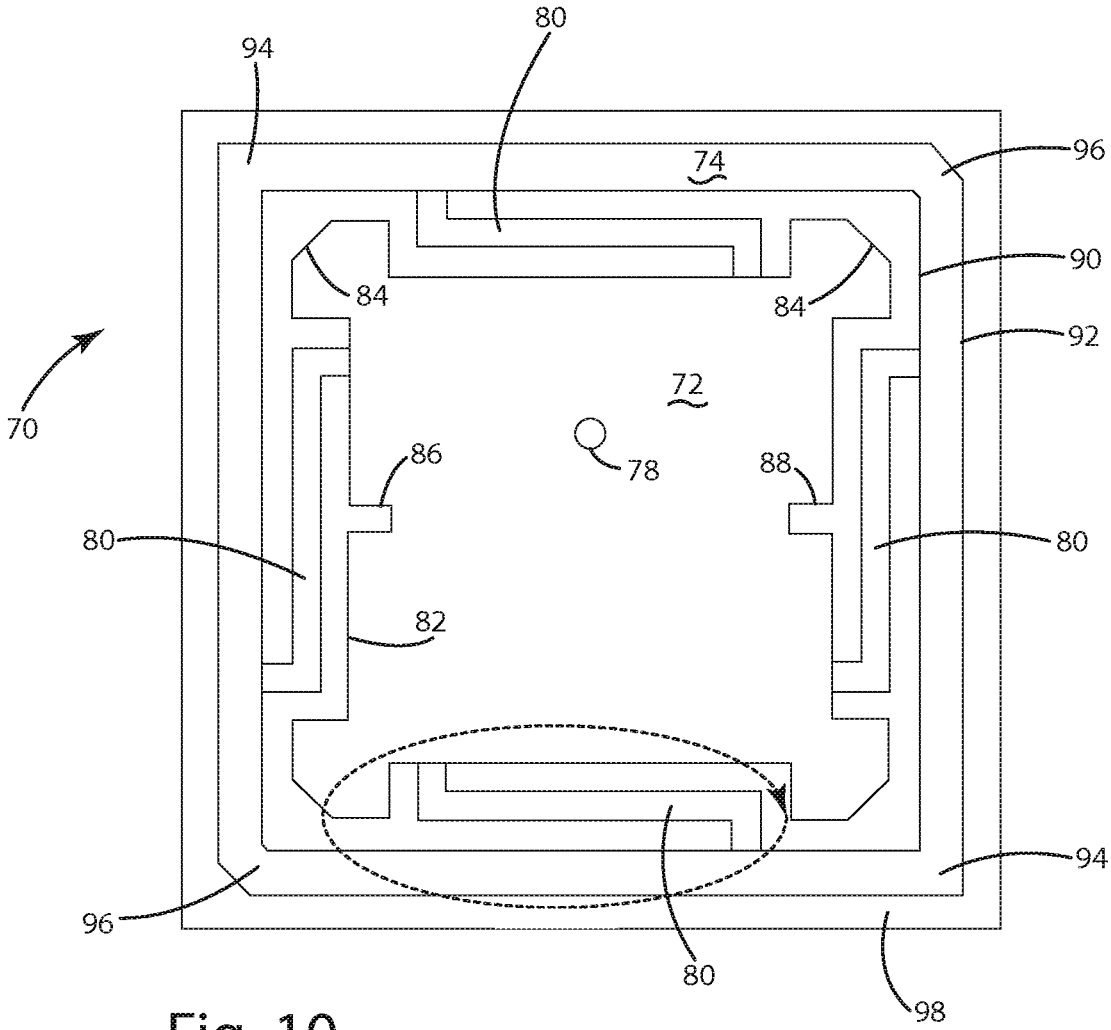
FIG. 10 is a top plan view of the patch antenna of FIG. 9.

An antenna constructed in accordance with a second embodiment of the invention is shown in FIGS. 9-10 and generally designated 70. The antenna 70 includes coplanar inner and outer conductive elements 72, 74 spaced apart from a conductive ground plane 76. A single feed 78 is connected to the inner conductive element 72, and the inner and outer conductive elements are connected to each other by a plurality of conductive traces 80. The inner conductive element 72 includes notches 86, 88 which determine the axial ratio of the antenna 70.

More particularly, the inner conductive element 72 (or plate element) is generally square when viewed in plan view as shown in FIG. 10. The inner conductive element 72 includes an outer periphery defining four sides 82 and four truncated corners 84. The sides 82 are disposed radially inward of the truncated corners 84, such that the truncated corners 84 extend outwardly beyond the sides 82. One or more sides 82 define a notch 86 in the inner conductive element 72 to tune the axial ratio of the patch antenna 70. The notch 86 extends radially inward, and is centered approximately midway along the length of the corresponding side. In the illustrated embodiment, the inner conductive element 72 defines a second notch 88. This second notch 88 is opposite the first notch 86, and is centered approximately midway along the length of corresponding side. The first and second notches 86, 88 share the same dimensions, such that the inner conductive element 72 includes symmetrical left and right sides when viewed in plan view in FIG. 10.

The outer conductive element 74 (or ring element) surrounds the inner conductive element 72. The outer conductive element 74 has a substantially square inner edge 90 and a substantially square outer edge 92. The two edges 90, 92 are substantially concentric, and the width of the outer conductive element 74 is uniform throughout its circumference. Two diagonally opposed corners 94 are substantially square, and two diagonally opposed corners 96 are substantially not square (e.g. truncated). The inner edge 90 of the outer conductive element 74 is spaced apart from the inner conductive element 72. Therefore, the conductive elements 72, 74 define a gap therebetween so that the conductive elements 72, 74 are physically separate from one another.

Conductive traces 80 extend between and interconnect the inner conductive element 72 and the outer conductive element 74. In the current embodiment, one trace 80 is provided on each of the four sides of the inner conductive element 72. A larger or smaller number of traces can be provided. Each trace 80 is relatively long and relatively thin. In the current embodiment, each trace 80 is longer than one-half the length of the associated side of the inner conductive element 72, and is almost the length of the side. The opposite ends of each trace 80 connected to the inner and outer conductive elements 72, 74. The remainder of each trace 80 is spaced apart from the inner and outer conductive elements 72, 74 and the width of each conductive trace 80 is generally uniform throughout its length.

The single feed 78 is connected off center of the inner conductive element 72 and extends through a dielectric substrate 98. The gap and conductive traces 80 are believed to function as an LC circuit. The relative shapes, sizes and orientations of the conductive elements 72, 78 and traces 80 can be tuned or otherwise modified to achieve the desired performance. In the current embodiment, the inner conductive element 72 is approximately 20.9 mm×20.9 mm. The corners 84 are angled at 45° with a 1.4 mm beveled edge. The recessed side 82 of the inner conductive element 72 is 14 mm. Each notch 86, 88 is 1.5 mm in length and 1 mm in width. The conductive trace 80 is 12 mm along its major axis, 3 mm along its minor axis, and 1 mm thick. The outer conductive element 74 is approximately 26.2 mm×26.2 mm and 1.6 mm wide. A 1 mm gap separates portions of the inner conductive element 72 from the outer conductive element 74. The feed 78 is 3 mm off of center, and the substrate 98 is 28.5 mm×28.5 mm×4 mm. The conductive elements 72, 74, conductive traces 80, and bottom layer 76 are silver or other suitable metal that is screened, printed or otherwise formed directly on the substrate 98. The conductive elements 72, 74 and traces 80 are substantially coplanar and are printed of the same material and thickness.

The antenna 70 is functionally similar to the antenna 10 of FIG. 1-4. In particular, the inner conductive element 72 can couple to a LHCP inner patch signal (e.g. SDARS) while the outer conductive element 74 couples to a RHCP outer patch signal (e.g. GPS). The conductive traces 80 are believed to prevent the inner patch signal from coupling to the outer conductive element 74, while also preventing the outer patch signal from coupling to the inner conducive element 72.

III. Third Embodiment

Figure 11:
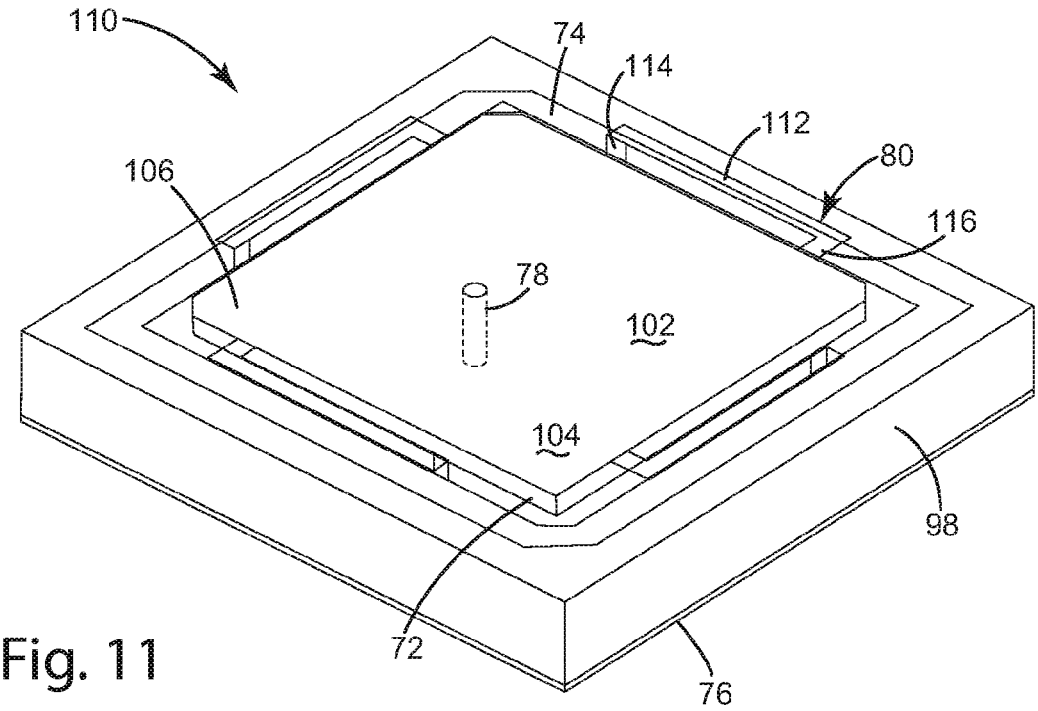
FIG. 11 is a perspective view of an antenna in accordance with a third embodiment of the invention.
Figure 12:
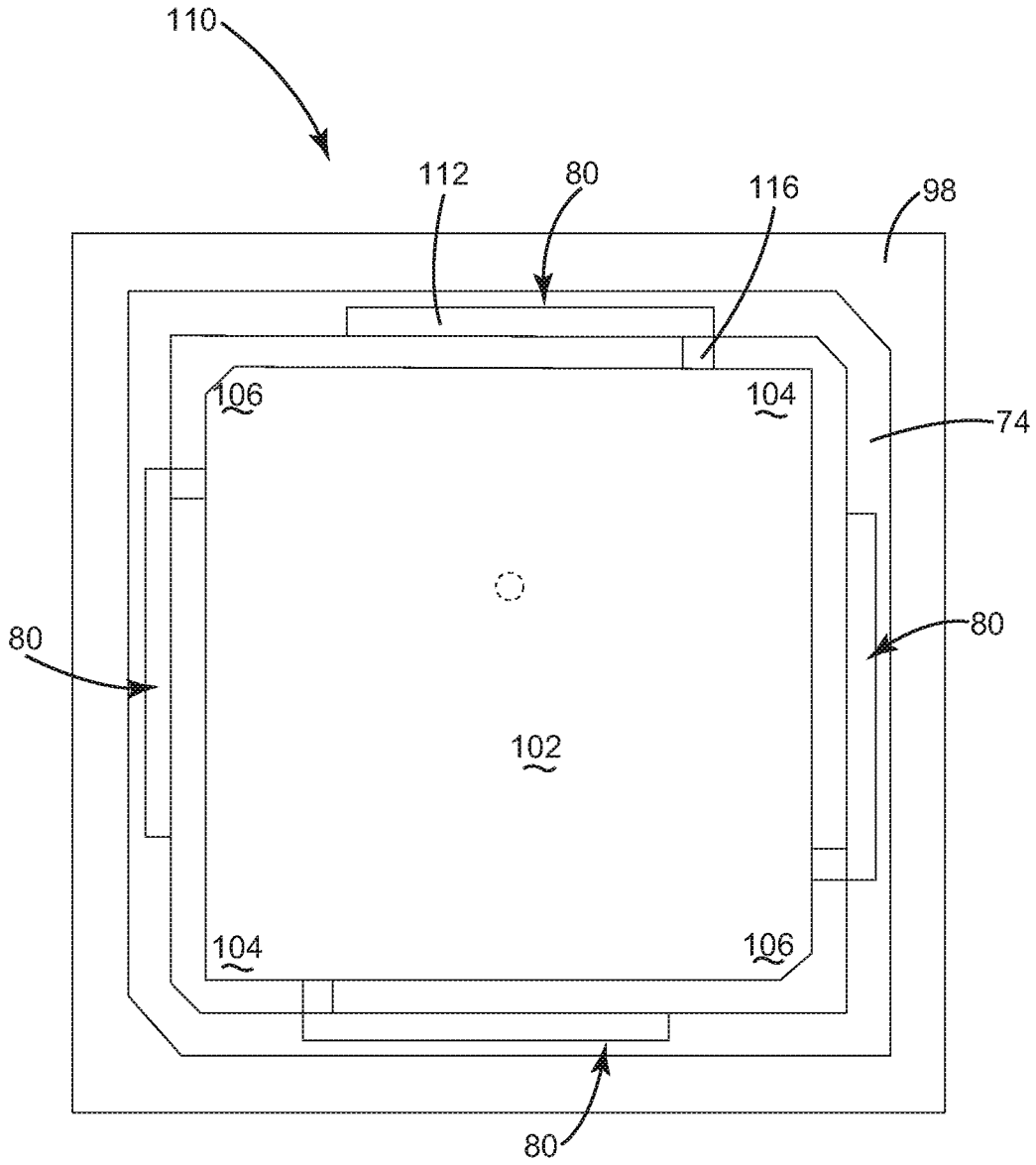
FIG. 12 is a top plan view of the antenna of FIG. 11.

An antenna constructed in accordance with a third embodiment of the invention is shown in FIGS. 11-12 and generally designated 110. The antenna 110 is structurally and functionally similar to the patch antenna 70 of FIGS. 9-10, and includes a conductive cover 102 disposed over and spaced apart from a substantially square inner conductive element 72. The cover 102 includes two diagonally opposed corners 104 that are substantially square, and two diagonally opposite corners 106 that are substantially not square (e.g. truncated).

The conductive connectors 80 have a relatively long, relatively thin intermediate portion 112. The opposite ends of each connector 80 are connected to the outer conductive element 74 and the conductive cover 102, respectively. The connector 80 includes a first end portion 114 extending upwardly from the outer conductive element 74 and a second end portion 116 extending in plane with the cover 102. The intermediate portion 102 extends between the first and second end portions 114, 116, running generally parallel to and in plane with the periphery of the cover 102.

Capacitive energy from the inner conductive element 72 is believed to pass to the cover 102. The cover 102 is shaped to closely correspond to the underlying inner conductive element 72 in order to cover the energy transmitted to the outer conductive element 74. To prevent coupling of the outer conductive element 74 to the inner patch signal (e.g. SDARS), the cover 102 and the connectors 80 act simultaneously as a band stop filter.

The relative shape, size and orientation of the connector 80 can be tuned or otherwise modified to achieve the desired performance. In the current embodiment, the patch antenna 110 includes four connectors 80 measuring 12.5 mm along a major axis. The first and second end portions are 1 mm thick and 1 mm in length, such that the gap between the connectors 80 and the cover 102 is 1 mm. The substrate 98 is 30 mm×30 mm×4 mm, and the outer conductive element 74 is 26.2 mm×26.2 mm×1.6 mm. The inner conductive element 72 and the cover 102 are substantially equally dimensioned at 20.9 mm×20.9 mm.

IV. Fourth Embodiment

Figure 13:
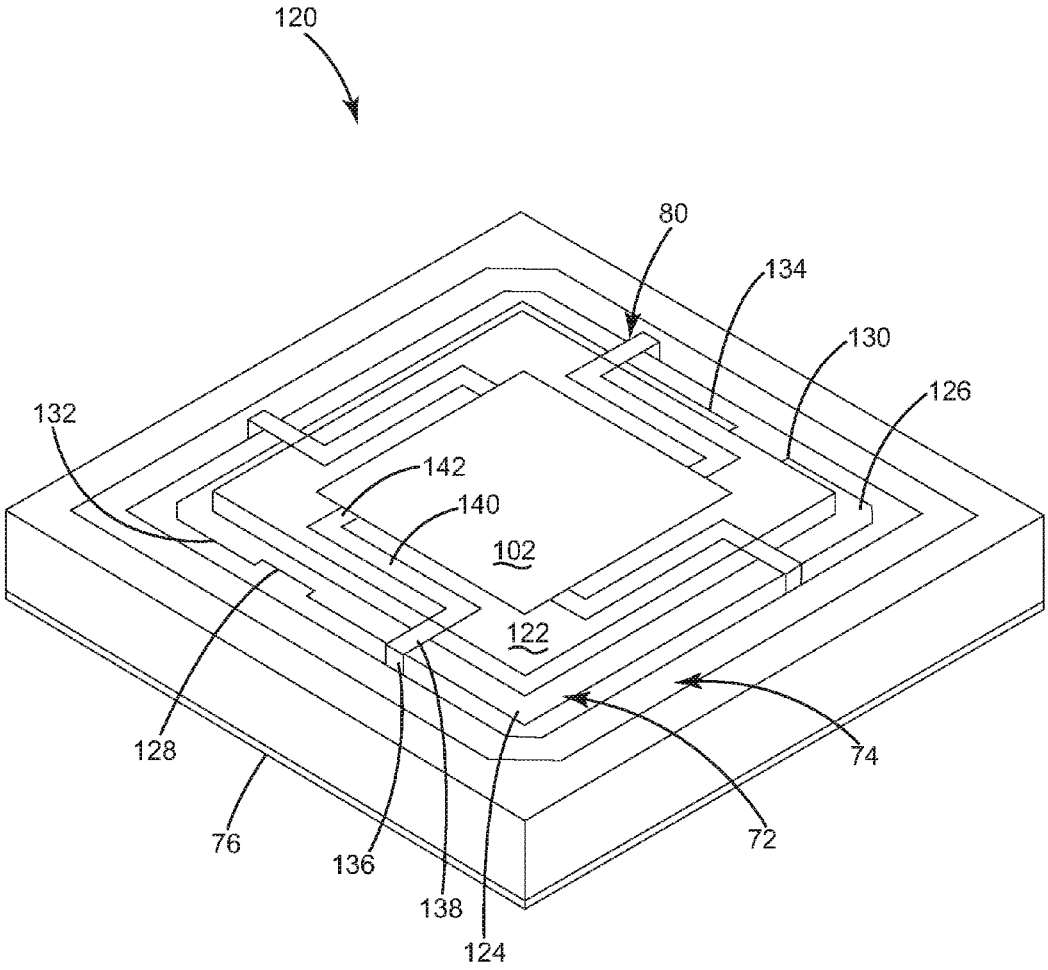
FIG. 13 is a perspective view of an antenna in accordance with a fourth embodiment of the invention.
Figure 14:
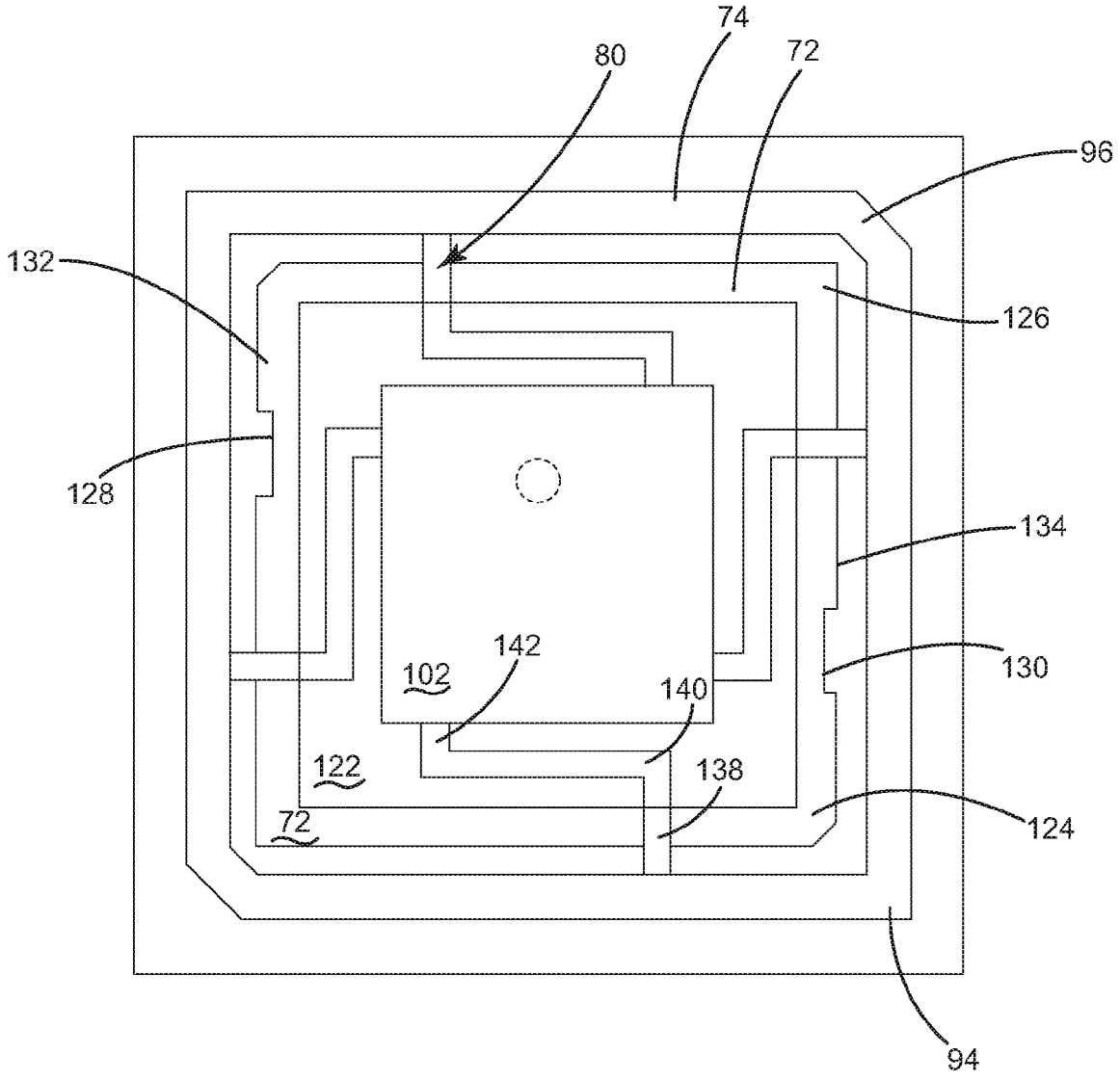
FIG. 14 is a top plan view of the antenna of FIG. 13.

An antenna constructed in accordance with a fourth embodiment of the invention is shown in FIGS. 13-14 and generally designated 120. The antenna 120 is structurally and functionally similar to the antenna 110 of FIGS. 11-12, and includes a dielectric layer 122 interposed between the cover 102 and the inner conductive element 72 to increase the capacitive coupling between the patch and the cover and to decrease cover size.

The dielectric layer 122 is substantially square shaped, having a height substantially equal to height of the conductive connectors 80. The cover 102 is also substantially square shaped, having reduced dimensions when compared to the dielectric layer 122. The inner conductive element 72 extends outwardly beyond the dielectric layer 122, and includes opposing square corners 124 and opposing truncated corners 126. The inner conductive element 72 defines first and second notches 128, 130 in opposing side edges 132, 134. The notches 128, 130 are offset from center, being closer to the truncated corners 126 than to the square corners 124. The notches 128, 130 are wider than they are deep, and stop short of the dielectric layer 122.

The connectors 80 include a first portion 136 extending upwardly from the outer conductive element 74, a second portion 138 extending radially inward toward the cover 102, a third portion 140 extending parallel to the conductive cover periphery, and a fourth portion 142 extending toward the cover 102. The second, third and fourth portions 138, 140, 142 are coplanar and are substantially "S" shaped when viewed in plan view. A feed 78 extends upwardly through the antenna 120 and is coupled to the cover 102 or to the inner conductive element 72.

The relative shape, size and orientation of the connector 120 can be tuned or otherwise modified to achieve the desired performance. In the current embodiment, the patch antenna 120 includes a cover 102 that is 12 mm×12 mm and spaced 1 mm above the inner conductive element 72. The dielectric layer 122 is 18 mm×18 mm×1 mm and is formed of Teflon® by DuPont de Nemours & Co. of Wilmington, Del. The inner conductive element 72 is 20.9 mm×20.9 mm, and the outer conductive element 74 is 26.2 mm×26.2 mm with a 1 mm gap therebetween. The conductor first portion 132 is 1 mm, second portion 134 is 5.5 mm, third portion 136 is 9 mm, and fourth portion 138 is 2 mm. The single feed 78 is connected 3 mm off center of the inner conductive element 72 and does not extend through the dielectric layer 122 to the cover.

The above descriptions are those of the current embodiments of the invention. Various alterations and changes can be made without departing from the spirit and broader aspects of the invention as defined in the appended claims, which are to be interpreted in accordance with the principles of patent law including the doctrine of equivalents. Any reference to elements in the singular, for example, using the articles "a," "an," "the," or "said," is not to be construed as limiting the element to the singular.

The invention claimed is:

1. A patch antenna comprising:

a first substantially planar, generally square antenna element including a periphery defining first and second notches in opposite sides of the generally square first antenna element;

a second substantially planar, generally square antenna element surrounding the first antenna element and defining a gap therebetween, the first and second antenna elements being substantially coplanar;

four conductors each conductively interconnecting one side of the first antenna element and one side of the second planar antenna element; and a feed conductively connected to the first antenna element, whereby the first antenna element resonates at a first frequency with a first circular polarization sense, and further whereby the first and second antenna elements together resonate at a second frequency with a second circular polarization sense.

2. The patch antenna of claim 1 wherein each conductor is within the gap between the first and second antenna elements.

3. The patch antenna of claim 1 further including a conductive ground plane spaced apart from the first and second antenna elements.

4. A patch antenna comprising:

a first substantially planar, generally square antenna element;

a second substantially planar, generally square antenna element surrounding the first antenna element and defining a gap therebetween, the first and second antenna elements being substantially coplanar;

four first conductors each conductively interconnecting one side of the first antenna element with one side of the second antenna element;

a generally square electrically conductive cover element over and spaced apart from the first antenna element; and four second conductors each conductively interconnecting one side of the second antenna element and one side of the cover element.

5. The patch antenna of claim 4 further including a dielectric element interposed between the second antenna element and the cover element.

6. The patch antenna of claim 4 wherein the cover element is in overlapping alignment with the plate element.

7. The patch antenna of claim 4 further including a conductive ground plane spaced apart from the second antenna element opposite the cover element.

8. The patch element of claim 4 further including a feed element connected to only one of the second antenna element and the cover element.

9. The patch element of claim 4 wherein the cover element is coextensive with the second antenna element.

10. The patch antenna of claim 4 wherein the first antenna element includes a periphery defining first and second notches in opposite sides of the generally square first antenna element.

11. The patch antenna of claim 4 wherein the first antenna element includes first and second diagonally opposed truncated corners.

12. The patch antenna of claim 4 wherein:

each first conductor defines a substantially uniform first width; and each second conductor defines a substantially uniform second width.

* * * * *